US008928446B2

(12) United States Patent
Yamashita et al.

(10) Patent No.: US 8,928,446 B2
(45) Date of Patent: Jan. 6, 2015

(54) TRANSFORMER

(75) Inventors: Shotaro Yamashita, Chiyoda-ku (JP); Yasuo Fujiwara, Chiyoda-ku (JP); Yuichiro Ishida, Chiyoda-ku (JP); Shingo Kano, Chiyoda-ku (JP)

(73) Assignee: Mitsubishi Electric Corporation, Chiyoda-Ku, Tokyo (JP)

( * ) Notice: Subject to any disclaimer, the term of this patent is extended or adjusted under 35 U.S.C. 154(b) by 0 days.

(21) Appl. No.: 13/984,041

(22) PCT Filed: May 25, 2011

(86) PCT No.: PCT/JP2011/061984
§ 371 (c)(1),
(2), (4) Date: Aug. 7, 2013

(87) PCT Pub. No.: WO2012/160672

PCT Pub. Date: Nov. 29, 2012

(65) Prior Publication Data

US 2013/0314199 A1 Nov. 28, 2013

(51) Int. Cl.
*H01F 27/32* (2006.01)

(52) U.S. Cl.
USPC ..... 336/84 M

(58) Field of Classification Search
USPC ..... 336/84 R, 84 C, 90, 65
See application file for complete search history.

(56) References Cited

U.S. PATENT DOCUMENTS

| | | | | |
|---|---|---|---|---|
| 4,156,862 | A * | 5/1979 | Hansen et al. | 336/73 |
| 4,231,074 | A * | 10/1980 | McNutt et al. | 361/44 |
| 5,546,065 | A * | 8/1996 | Vinciarelli et al. | 336/84 C |
| 2011/0298575 | A1* | 12/2011 | Cranganu-Cretu et al. | 336/84 M |

FOREIGN PATENT DOCUMENTS

| | | | |
|---|---|---|---|
| JP | 56-32423 | A | 3/1981 |
| JP | 56-81914 | A | 7/1981 |
| JP | 60-219717 | A | 11/1985 |
| JP | 63-10533 | A | 1/1988 |
| JP | 63-215028 | A | 9/1988 |
| JP | 8-83721 | A | 3/1996 |
| JP | 10-116741 | A | 5/1998 |
| JP | 2001-244128 | A | 9/2001 |

OTHER PUBLICATIONS

International Search Report (PCT/ISA/210) issued on Aug. 23, 2011, by the Japanese Patent Office as the International Searching Authority for International Application No. PCT/JP2011/061984.
Notice of Grounds of Rejection issued Feb. 21, 2012 in Japanese Application No. 2011-549778 (7 pages).

* cited by examiner

*Primary Examiner* — Tuyen Nguyen
(74) *Attorney, Agent, or Firm* — Buchanan Ingersoll & Rooney PC

(57) ABSTRACT

An electromagnetic shield includes a plurality of magnetic thin plates stacked on each other, a pair of metal plates sandwiching the plurality of magnetic thin plates, and a plurality of seat plates each connected to the pair of metal plates. The plurality of seat plates are disposed at positions where the total sum of a leakage flux interlinked with a region between mutually adjacent first and second seat plates among the plurality of seat plates is equal to zero. Preferably, a distance between the first and second seat plates is equal to a value which is an integral multiple of a half period of the distribution of the leakage flux.

4 Claims, 8 Drawing Sheets

TRANSFORMER

TECHNICAL FIELD

The present invention relates to a transformer, and particularly to a structure for supporting an electromagnetic shield disposed in a transformer.

BACKGROUND ART

Generally, an oil-filled transformer is provided with a transformer main body and a tank configured to house the transformer main body. The transformer main body includes a high-voltage coil, a low-voltage coil and an iron core. The tank is filled with insulating oil, and the transformer main body is immersed in the insulating oil.

The tank is generally made of steel material. In order to prevent a magnetic flux leaked out of the transformer main body from entering into the tank, an electromagnetic shield is mounted on an inner wall of the tank.

For example, Japanese Patent Laying-Open No. 60-219717 (PTD 1) discloses an electromagnetic shield used in a transformer. The electromagnetic shield is formed to include a plurality of stacked magnetic thin plates and a pair of metal plates sandwiching the plurality of magnetic thin plates. A plurality of seat plates are prepared for mounting the electromagnetic shield in the tank. The plurality of seat plates are joined to the electromagnetic shield and to the inner wall of the tank by welding. Thereby, the electromagnetic shield is mounted in the tank.

CITATION LIST

Patent Document

PTD 1: Japanese Patent Laying-Open No. 60-219717

SUMMARY OF INVENTION

Technical Problem

Two seat plates, one of the pair of metal plates sandwiching the plurality of magnetic thin plates, and a steel plate on which the seat plate is mounted form a closed circuit. When a leakage flux generated by the coil passes through a region between the two seat plates of the electromagnetic shield, a circulation current may be induced in the closed circuit, and the circulation current may lead to the occurrence of stray load loss in the transformer.

An object of the present invention is to reduce transformer loss more effectively.

Solution to Problem

A transformer according to an aspect of the present invention includes a tank and a transformer main body housed in the tank. The transformer main body includes an iron core, and a coil wrapped around the iron core. The transformer further includes a plurality of electromagnetic shields. Each of the plurality of electromagnetic shields includes a plurality of magnetic thin plates stacked on each other, a pair of metal plates sandwiching the plurality of magnetic thin plates, and a plurality of mounting members each connected to the pair of metal plates. The plurality of mounting members are disposed at positions where the total sum of a leakage flux interlinked with a region between mutually adjacent first and second mounting members among the plurality of mounting members is equal to zero,

Advantageous Effects of Invention

According to the present invention, it is possible to reduce stray load loss in the transformer. Thereby, according to the present invention, the transformer loss can be reduced.

DESCRIPTION OF EMBODIMENTS

Figure 1:
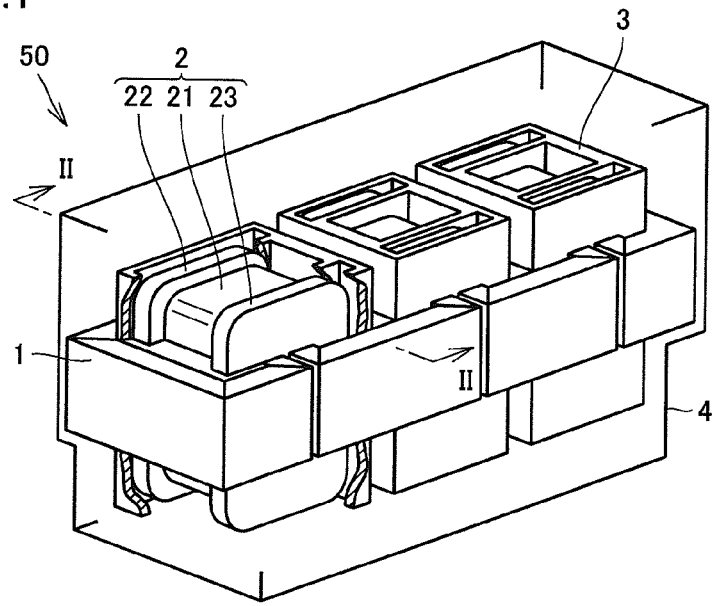
FIG. 1 is a schematic view illustrating a transformer according to an embodiment of the present invention.

Hereinafter, embodiments of the present invention will be described in detail with reference to the drawings. The same or equivalent parts in the drawings will be assigned with the same reference numerals and descriptions thereof will be not be repeated.

Embodiment 1

FIG. 1 is a schematic view illustrating a transformer according to an embodiment of the present invention. With reference to FIG. 1, a transformer 50 includes a plurality of iron cores 1 and a plurality of coils 2 wrapped respectively around the plurality of iron cores 1. The plurality of iron cores 1 and the plurality of coils 2 constitute the transformer main body.

Each of the plurality of iron cores 1 is in the form of a ring. Coil 2 is wrapped around two adjacent iron cores 1. An insulating material 3 covers coil 2. Coil 2 includes a high-voltage coil 21 and low-voltage coils 22 and 23. High-voltage coil 21 is disposed between low-voltage coils 22 and 23.

Transformer 50 further includes a tank 4 for housing the transformer main body. Though not shown in the drawings, tank 4 is filled with insulating oil. During the operation of transformer 50, the insulating oil is circulated to cool the transformer main body. Tank 4 is made of steel material.

Figure 2:
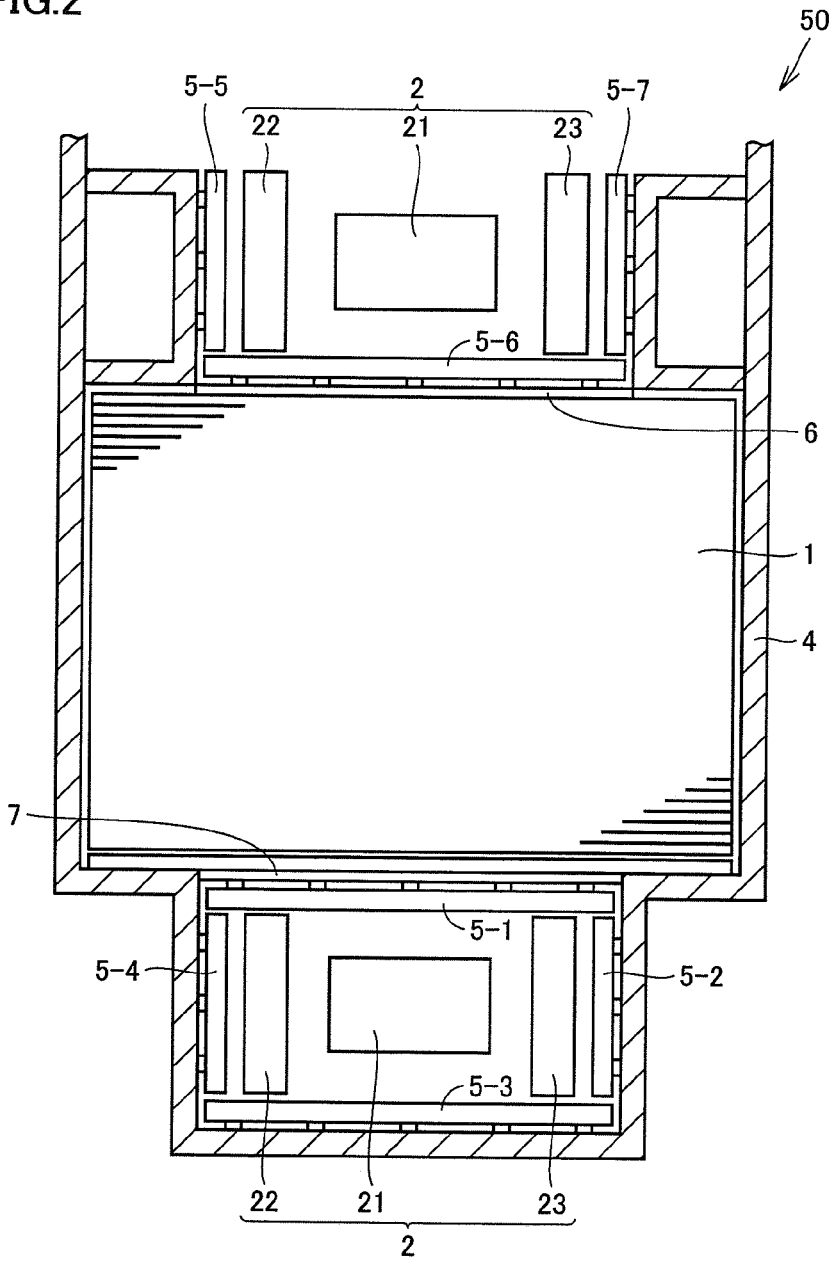
FIG. 2 is a cross-sectional view illustrating a part of the transformer along line II-II of FIG. 1.

FIG. 2 is a cross-sectional view illustrating a part of the transformer along line II-II of FIG. 1. With reference to FIG.

2, transformer 50 includes iron core 1, coil 2, electromagnetic shields 5-1 to 5-7, a tongue wedge 6, and a tongue support 7. In FIG. 2, insulating material 3 is not illustrated for the purpose of describing the disposition of electromagnetic shields 5-1 to 5-7.

Tongue wedge 6 is disposed on the top of iron core 1. Tongue support 7 is disposed across an opening portion of coil 2 to support iron core 1. Tongue support 7 is configured to extend between flanges at a lower portion of the tank. Tongue wedge 6 and tongue support 7 are made of steel material. Tongue wedge 6 and tongue support 7 are configured to fix iron core 1. High-voltage coil 21, low-voltage coil 22 and low-voltage coil 23 are disposed coaxially.

Figure 3:
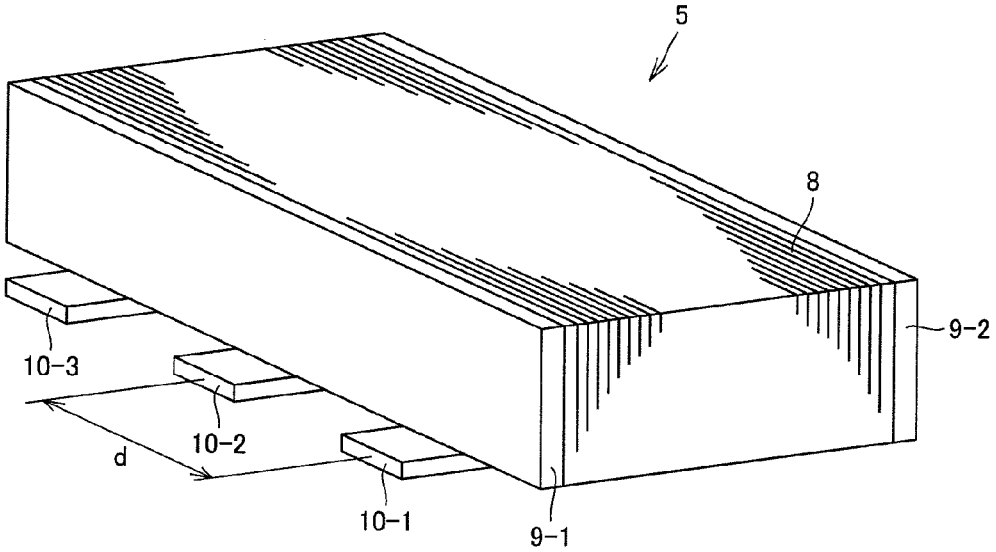
FIG. 3 is a view illustrating one unit of electromagnetic shields 5-1 to 5-7 illustrated in FIG. 2.

FIG. 3 is a view illustrating one unit of electromagnetic shields 5-1 to 5-7 illustrated in FIG. 2. With reference to FIG. 2 and FIG. 3, electromagnetic shield 5 includes a plurality of magnetic thin plates 8 stacked on each other, metal plates 9-1 and 9-2 sandwiching the plurality of magnetic thin plates 8, and a plurality of seat plates 10-1 to 10-3. Metal plates 9-1 and 9-2 and seat plates 10-1 to 10-3 are made of, for example, iron or stainless steel.

Seat plates 10-1 to 10-3 function as a mounting member, respectively. Each of seat plates 10-1 to 10-3 is joined to metal plates 9-1 and 9-2 by welding. Seat plates 10-1 to 10-3 are thereafter mounted on the inner wall of tank 4, tongue wedge 6 or tongue support 7 by welding. Accordingly, electromagnetic shield 5 is mounted at a desired position. Specifically, electromagnetic shield 5-1 is mounted on tongue support 7, electromagnetic shields 5-2, 5-3 and 5-4 are mounted on the inner wall of (a lower portion of) tank 4, electromagnetic shields 5-5 and 5-7 are mounted on the inner wall of tank 4, and electromagnetic shield 5-6 is mounted on tongue wedge 6. In the present embodiment, a metal plate is illustrated as the mounting member. It should be noted that the shape of the mounting member is not limited to any of those illustrated in FIG. 3.

When transformer 50 is in operation, coil 2 generates a leakage flux. Magnetic shields 5-1 to 5-7 are disposed to prevent the leakage flux from entering into tongue wedge 6 or tongue support 7.

Figure 4:
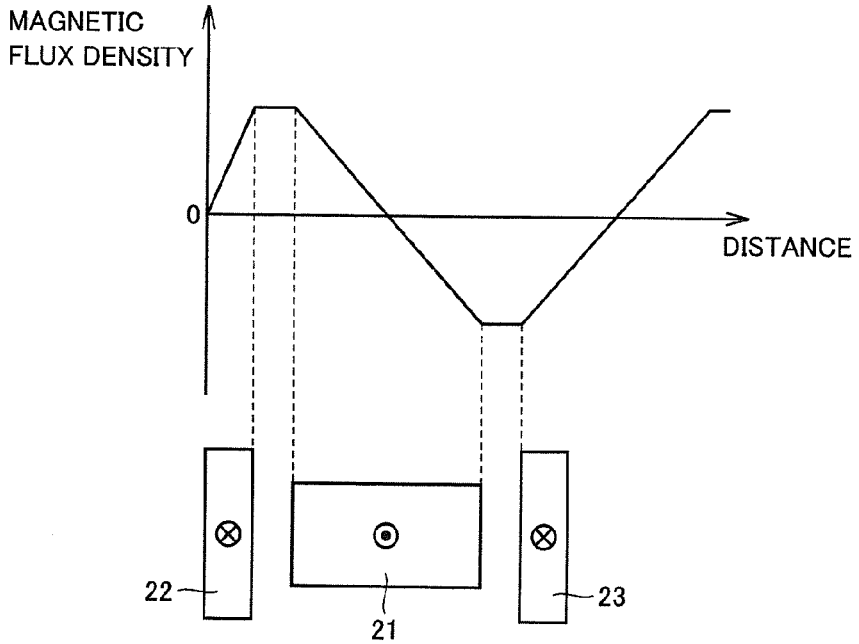
FIG. 4 is a view for explaining a leakage flux from a coil 2.

FIG. 4 is a view for explaining the leakage flux from coil 2. With reference to FIG. 4, the density of the leakage flux reaches a positive peak value or a negative peak value in a region between the high-voltage coil and the low-voltage coil. For example, in the example illustrated by FIG. 4, the density of the leakage flux reaches a positive peak value in the region between high-voltage coil 21 and low-voltage coil 22, and meanwhile, the density of the leakage flux reaches a negative peak value in the region between high-voltage coil 21 and low-voltage coil 23. However, the relationship of the positive peak value of the leakage flux and the negative peak value thereof respectively relative to the two regions may be reverse to the one mentioned above.

Figure 5:
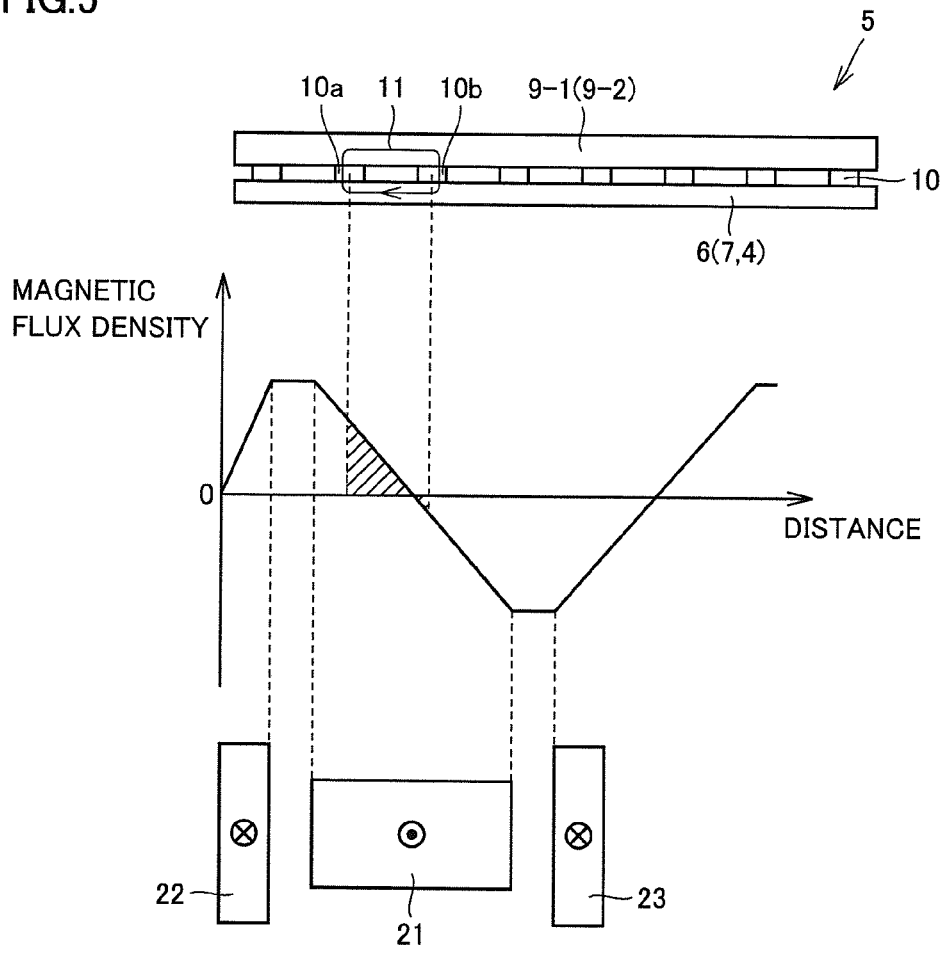
FIG. 5 is a view illustrating an electromagnetic shield according to a comparative example in the present embodiment and a circulation current generated in the electromagnetic shield.

FIG. 5 is a view illustrating an electromagnetic shield according to a comparative example in the present embodiment and a circulation current generated in the electromagnetic shields. With reference to FIG. 5, the hatched region in the graph illustrates an integration value of the magnetic flux density of the leakage flux interlinked with the region between two seat plates 10*a* and 10*b* (the same applies to the subsequent drawings). In the example illustrated by FIG. 5, the integration value of the magnetic flux density over the range of positive values of the magnetic flux density is different from the absolute integration value of the magnetic flux density over the range of negative values of the magnetic flux density. Therefore, the integration value of the magnetic flux density of the leakage flux interlinked with the region between the two seat plates 10*a* and 10*b* is not equal to zero.

Thereby, a circulation current 11 flows in a closed circuit formed by seat plates 10*a* and 10*b*, tongue wedge 6 and metal plate 9-1. Although not shown, a circulation current also appears in a closed circuit opposite to the illustrated circuit in FIG. 5, in other words, in a closed circuit formed by seat plates 10*a* and 10*b*, tongue wedge 6 and metal plate 9-2. Moreover, the same phenomenon occurs in the electromagnetic shields mounted on tongue support 7 or tank 4. The flowing of circulation current 11 in the closed circuit brings about stray load loss.

To cope with this problem, in the present embodiment, a plurality of seat plates 10 are disposed in such a way that the total sum of the leakage flux interlinked with the region between two seat plates is equal to zero. Hereinafter, the disposition of the plurality of seat plates 10 will be described in detail.

Figure 6:
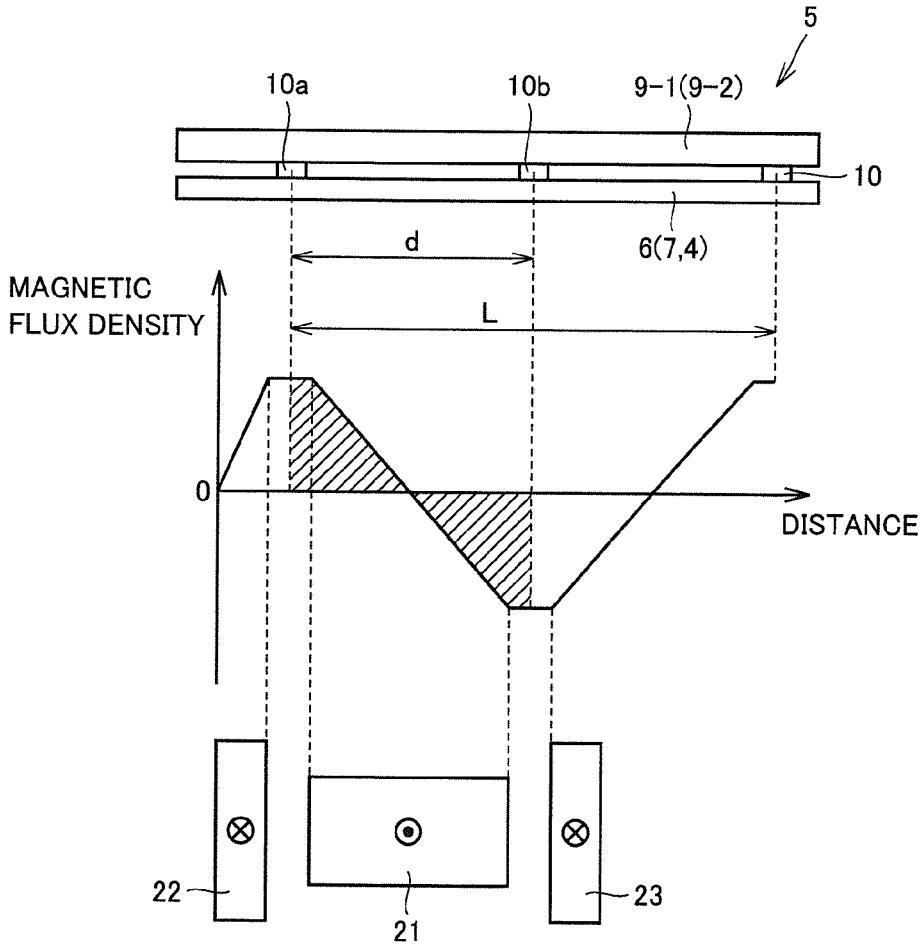
FIG. 6 is a view illustrating a configuration example of the electromagnetic shield according to an embodiment of the present invention and a leakage flux interlinked with a region between two seat plates of the electromagnetic shield.

FIG. 6 is a view illustrating a configuration example of the electromagnetic shield according to an embodiment of the present invention and the leakage flux interlinked with a region between two seat plates of the electromagnetic shield. With reference to FIG. 6, a distance d between two seat plates in one specific embodiment is set equal to ½ of a period L of the density distribution of the leakage flux (d=L/2). One of the two seat plates is mounted at a position corresponding to the positive peak value of the leakage flux density and the other is mounted at a position corresponding to the negative peak value of the leakage flux density. Thereby, the integration value of the positive magnetic flux density is substantially equal to the absolute integration value of the negative magnetic flux density. Accordingly, the total sum of the leakage flux interlinked with the region between seat plates 10*a* and 10*b* can be made substantially equal to zero.

Since the total sum of the leakage flux is substantially equal to zero, it is possible to reduce the circulation current generated in the closed circuit formed by metal plate 9-1, seat plates 10*a* and 10*b*, and tongue wedge 6. As a result, it is possible to reduce the stray load loss, and thereby the transformer loss can be reduced effectively.

As mentioned above, it is ideal that the density of the leakage flux reaches a positive peak value in the region between high-voltage coil 21 and low-voltage coil 22. Similarly, it is ideal that the density of the leakage flux reaches a negative peak value in the region between high-voltage coil 21 and low-voltage coil 23. Accordingly, it is possible to estimate period L of the density distribution of the leakage flux on the basis of the dispositions of high-voltage coil 21 and low-voltage coils 22 and 23. Thereby, distance d between the two seat plates can be determined. As a result thereof, it is possible to determine the positions of the plurality of seat plates 10. It is acceptable to use the other approaches, for example, electromagnetic field simulation or the like, to estimate period L of the density distribution of the leakage flux, the position corresponding to the positive peak value of the magnetic flux density, and the position corresponding to the negative peak value of the magnetic flux density. The positions of seat plates may be strictly identical to the positions of the peak values of the magnetic flux densities or may be nearby the positions of the peak values.

Figure 7:
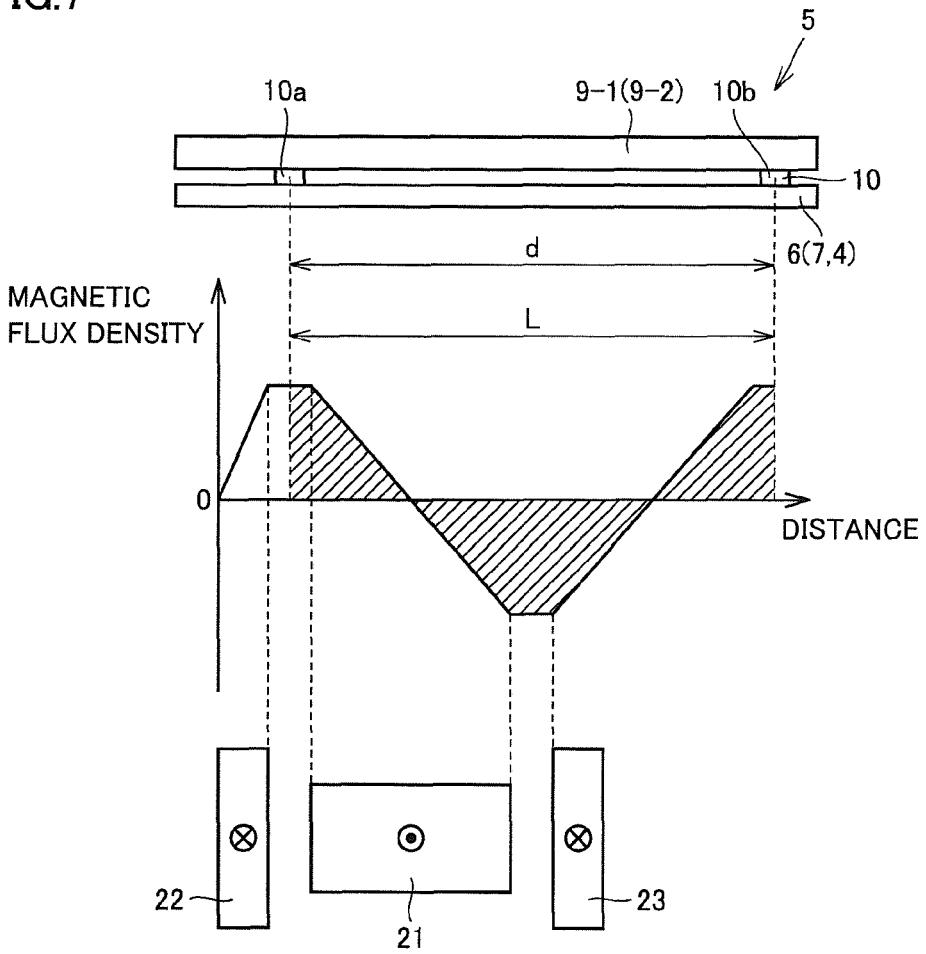
FIG. 7 is a view illustrating another configuration example of the electromagnetic shield according to an embodiment of the present invention and a leakage flux interlinked with a region between two seat plates of the electromagnetic shield.

FIG. 7 is a view illustrating another configuration example of the electromagnetic shield according to the present embodiment and the leakage flux interlinked with the region between two seat plates of the electromagnetic shield. With reference to FIG. 7, in the configuration example, distance d between two seat plates is set as great as period L of the density distribution of the leakage flux (d=L).

Again in this situation, the integration value of the positive values of the magnetic flux density is substantially equal to the absolute integration value of the negative values of the magnetic flux density. Accordingly, the total sum of the leakage flux interlinked with the region between seat plates 10*a* and 10*b* can be made substantially equal to zero. As a result, it is possible to reduce the stray load loss, and thereby the transformer loss can be reduced effectively.

In FIG. 7, the positions of seat plates are identical to the positions corresponding to the positive peak values of the magnetic flux density of the leakage flux. However, according to the configuration of the magnetic shield illustrated in FIG. 7, the positions of seat plates may not be limited to the abovementioned case so as to make the integration value of the magnetic flux density in one period of the magnetic flux density distribution equal to zero. Thus, according to the configuration illustrated in FIG. 7, it is possible to increase the degree of freedom in disposing the magnetic shields.

As illustrated in FIG. 6 and FIG. 7, distance d between two seat plates may be defined according to the following equation:

$$(L/2)\times m$$

where m is an integer equal to 1 or greater than 1. When m is an odd integer, it is preferable that two adjacent seat plates among the plurality of seat plates 10 are mounted to steel material such as the tongue wedge or the like in the following way. Specifically, one of the two seat plates is mounted at a position corresponding to the positive peak density value of the leakage flux and the other one is mounted to the negative peak density value of the leakage flux. Thereby, it is possible to make smaller the total sum of the leakage flux (ideally the total sum of the leakage flux is equal to zero) interlinked with the region between the two seat plates. On the other hand, when m is an even integer, the positions of seat plates may not be restricted to the positions where the leakage flux has the peak density values.

As illustrated in FIG. 2, it is preferable that the magnetic shield according to an embodiment of the present invention is mounted on at least a tongue member (tongue wedge 6 and tongue support 7). In other words, the magnetic shield according to an embodiment of the present invention is preferred to be disposed in a region between the iron core and the coil. The magnetic flux density of the leakage flux interlinked with the region between two seat plates is greater especially in the tongue member. Thereby, by mounting the magnetic shield according to an embodiment of the present invention at the tongue member, it is possible to reduce the transformer loss effectively.

More preferably, the magnetic shield according to an embodiment of the present invention is mounted not only at the tongue member but also on the inner wall of tank 4. The magnetic shield mounted to tank 4 functions to prevent the leakage flux generated by the coil from entering into tank 4. Thereby, the transformer loss can be further reduced.

Embodiment 2

The overall configuration of the transformer according to Embodiment 2 is similar to that illustrated in FIG. 1 and FIG. 2. Moreover, the configuration of the magnetic shield according to Embodiment 2 is similar to that illustrated in FIG. 3.

In Embodiment 1, distance d between the two seat plates of the magnetic shield is set equal to, for example, a half of or as great as the period of the density distribution of the leakage flux. However, as distance d increases, the supporting strength of the magnetic shield may decrease accordingly.

In Embodiment 2, a spacer is disposed between two seat plates. Thereby, it is possible to prevent the supporting strength of the magnetic shield from decreasing. The spacer is made of an insulating material.

Figure 8:
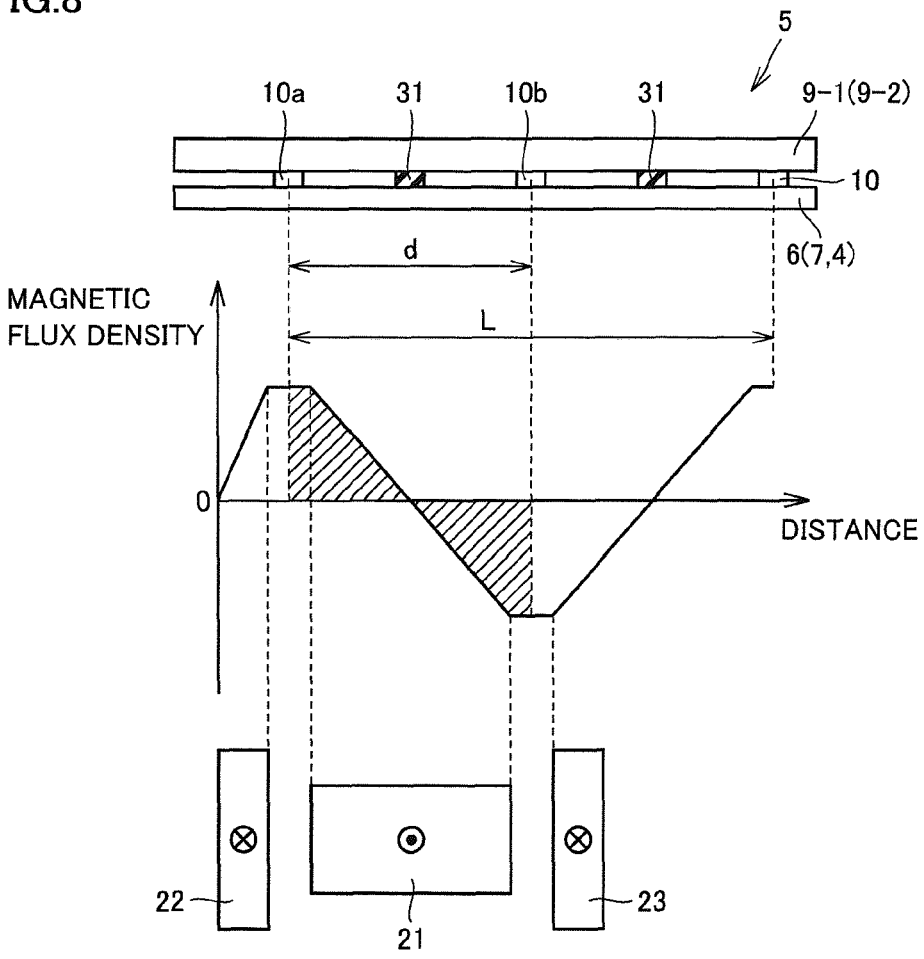
FIG. 8 is a view illustrating an example of a support structure for the electromagnetic shield according to Embodiment 2 of the present invention.

FIG. 8 is a view illustrating an example of a support structure for the electromagnetic shield according to Embodiment 2 of the present invention. With reference to FIG. 8, an insulating spacer 31 is inserted into a portion of the region between two seat plates. In other words, such configuration increases the supporting strength of the magnetic shield through a point support by insulating spacer 31.

Figure 9:
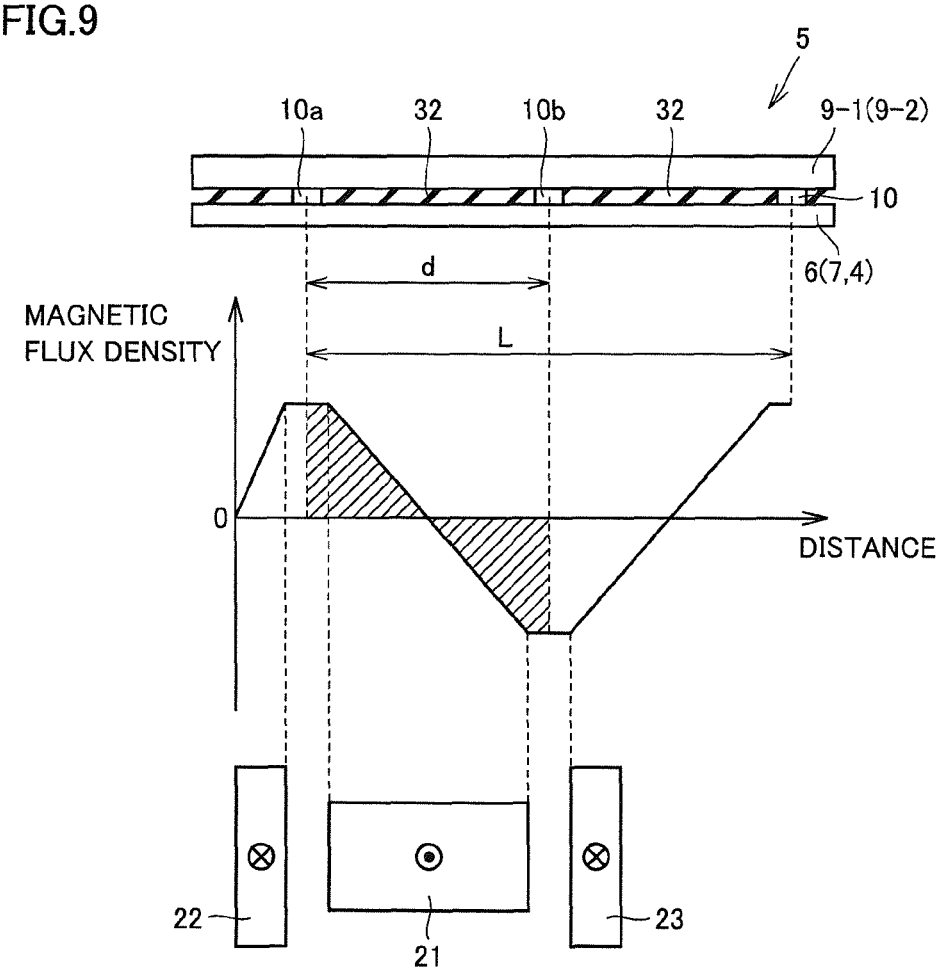
FIG. 9 is a view illustrating another example of a support structure for the electromagnetic shield according to Embodiment 2 of the present invention.

FIG. 9 is a view illustrating another example of a support structure for the electromagnetic shield according to Embodiment 2 of the present invention. With reference to FIG. 9, an insulating spacer 32 is inserted to fill the entire region between two seat plates. In other words, such configuration increases the supporting strength of the magnetic shield through a surface support by insulating spacer 32.

Since distance d between two seat plates is similar to that in Embodiment 1, the subsequent description thereof will not be repeated.

As mentioned above, according to Embodiment 2, the transformer loss can be reduced effectively as in Embodiment 1. Furthermore, according to Embodiment 2, it is possible to prevent the supporting strength of the magnetic shield from decreasing even though the distance between seat plates is widened.

It should be understood that the embodiments disclosed herein have been presented for the purpose of illustration and description but not limited in all aspects. It is intended that the scope of the present invention is not limited to the description above but defined by the scope of the claims and encompasses all modifications equivalent in meaning and scope to the claims.

REFERENCE SIGNS LIST

1: iron core; 2: coil; 3: insulating material; 4: tank; 5, 5-1, 5-2, 5-3, 5-4, 5-5, 5-6, 5-7: electromagnetic shield; 6: tongue wedge; 7: tongue support; 8: magnetic thin plate; 9-1, 9-2: metal plate; 10, 10-1, 10-2, 10-3, 10*a*, 10*b*: seat plate; 11: circulation current; 21: high-voltage coil; 22, 23: low-voltage coil; 31, 32: insulating spacer; 50: transformer; L: period; d: distance

The invention claimed is:

1. A transformer comprising:

a tank;

a transformer main body housed in said tank, said transformer main body including an iron core and a coil wrapped around said iron core; and a plurality of electromagnetic shields, each of said plurality of electromagnetic shields including:

a plurality of magnetic thin plates stacked on each other;

a pair of metal plates sandwiching said plurality of magnetic thin plates; and a plurality of mounting members each connected to said pair of metal plates, said plurality of mounting members being disposed at positions where the total sum of a leakage flux interlinked with a region between mutually adjacent first and second mounting members among said plurality of mounting members is equal to zero, said coil including a first low-voltage coil, a second low-voltage coil, and a high-voltage coil which are disposed coaxially, said high-voltage coil being disposed between said first low-voltage coil and said second low-voltage coil, the distribution of said leakage flux being defined by said first low-voltage coil, said second low-voltage coil and said high-voltage coil, a distance between said first and second mounting members being equal to a value which is an odd multiple of a half period of the distribution of said leakage flux, said first mounting member being disposed at a position corresponding to a positive peak value of a magnetic flux density of said leakage flux, and said second mounting member being disposed at a position corresponding to a negative peak value of said magnetic flux density of said leakage flux.

2. The transformer according to claim 1, further comprising a fixing member disposed between said iron core and said coil for fixing said iron core, wherein said plurality of electromagnetic shields include a first electromagnetic shield, and said plurality of mounting members of said first electromagnetic shield are mounted on said fixing member.

3. The transformer according to claim 2, wherein said plurality of electromagnetic shields include a second electromagnetic shield, and said plurality of mounting members of said second electromagnetic shield are mounted on an inner wall of said tank.

4. The transformer according to claim 1, further comprising a spacer inserted between said first and second mounting members, wherein said spacer is made of an insulating material.

* * * * *